US012383068B1

(12) United States Patent
Wang

(10) Patent No.: US 12,383,068 B1
(45) Date of Patent: Aug. 12, 2025

(54) LEG PILLOW

(71) Applicant: GUANGZHOU LIKEGAO IMPORT & EXPORT CO., LTD, Guangzhou (CN)

(72) Inventor: Bizhong Wang, Guangzhou (CN)

(73) Assignee: GUANGZHOU LIKEGAO IMPORT & EXPORT CO., LTD, Guangzhou (CN)

( * ) Notice: Subject to any disclaimer, the term of this patent is extended or adjusted under 35 U.S.C. 154(b) by 0 days.

(21) Appl. No.: 18/975,814

(22) Filed: Dec. 10, 2024

(51) Int. Cl.
*A47C 20/02* (2006.01)

(52) U.S. Cl.
CPC ..... *A47C 20/021* (2013.01)

(58) Field of Classification Search
CPC ..... A47C 20/021; A47C 2009/1018
USPC ..... 5/648
See application file for complete search history.

(56) References Cited

U.S. PATENT DOCUMENTS 2,877,472 A * 3/1959 Wagner ..... A47G 9/10 5/636
5,216,771 A * 6/1993 Hoff ..... A47C 20/025 5/652
6,789,282 B1 * 9/2004 Frydman ..... A47C 20/021 5/648
D582,611 S * 12/2008 Bise ..... D30/118
D846,312 S * 4/2019 Davis ..... D6/601
D898,443 S * 10/2020 Romano ..... D6/601
10,993,556 B2 * 5/2021 Davis ..... A47C 27/065
D930,401 S * 9/2021 Ye ..... D6/601
D975,471 S * 1/2023 Zhang ..... D6/601
D1,006,494 S * 12/2023 Zhu ..... D6/601
D1,028,574 S * 5/2024 Zhu ..... D6/601
D1,033,990 S * 7/2024 Song ..... D6/601
2003/0046767 A1 * 3/2003 Roston ..... A47C 20/021 5/648
2005/0138733 A1 * 6/2005 Riesberg ..... A47G 9/10 5/636
2008/0092297 A1 * 4/2008 Davis ..... A47C 20/021 5/648
2011/0162146 A1 * 7/2011 Frydman ..... A47G 9/109 5/639
2016/0081867 A1 * 3/2016 O'Sullivan ..... A47C 27/148 5/709
2016/0113408 A1 * 4/2016 Shaffer ..... A47G 9/10 5/648
2021/0321800 A1 * 10/2021 Carver ..... A47G 9/1081
2022/0160151 A1 * 5/2022 Mani ..... A47G 9/1045

* cited by examiner

*Primary Examiner* — Myles A Throop

(57) ABSTRACT

A leg pillow includes a pillow main body used for supporting between a first leg portion and a second leg portion of a user. The pillow main body includes an upper left side edge, an upper right side edge, a first contact surface, a lower left side edge, a lower right side edge, a second contact surface, an upper front side edge, a lower front side edge, a front end surface, an upper rear side edge, a lower rear side edge, a rear end surface, and a through hole. The first contact surface extends between the upper left side edge and the upper right side edge. The second contact surface extends between the lower left side edge and the lower right side edge. The second contact surface is opposite to the first contact surface. The rear end surface is opposite to the front end surface.

18 Claims, 6 Drawing Sheets

LEG PILLOW

TECHNICAL FIELD

The present invention relates to the field of leg pillows, particularly to a leg pillow.

BACKGROUND ART

Many people have problems with lower back pain, and it is often difficult to find a comfortable sleeping position during sleep. People with muscle spasms, menstrual cramps, varicose veins, and sciatica often find sleeping very distressing.

In daily life during the day, when the hips rotate, your spine will not align in a straight line. However, when sleeping at night, it is advisable to ensure that the spine is in a straight line as much as possible to avoid pain the next morning.

Therefore, people often sleep on their side when sleeping. When sleeping on the side, due to the gap between the legs, the upper leg hangs down on the bed surface or presses down on the lower leg due to gravity. At this time, the soft tissue on the outer side of the upper thigh is in an elongated state, leading to hip joint flexion and adduction, *piriformis* muscle being pulled, and sciatic nerve being compressed, which may cause radiating pain in the lower limbs. Over time, it may lead to skewed knee joint and ankle joint, resulting in long-term pain.

Therefore, there is a need for a leg pillow on the market. When sleeping on the side, the leg pillow can be clamped between the two legs. The leg pillow can ensure that the legs are at the same height as the pelvis. When the spine is aligned in a straight line, the pressure on the nerves will be released, greatly improving the pain situation. Moreover, pressure on the lower back and buttocks can also be relieved, and swelling on the lower back can be reduced, thereby allowing people to sleep well.

SUMMARY

In order to overcome the shortcomings of the prior art, a leg pillow is provided in the present invention. When sleeping on the side, the leg pillow can be clamped between two legs. The leg pillow can ensure that the legs are at the same height as the pelvis. When the spine is arranged in a straight line, the pressure on the nerves will be released, greatly improving the pain situation. Moreover, pressure on the lower back and buttocks can also be relieved, and swelling on the lower back can be reduced, thereby allowing people to sleep well.

The technical solution adopted by the present invention to solve its technical problem is as follows.

A leg pillow is provided in the present invention. The leg pillow includes a pillow main body. The pillow main body is used for supporting between a first leg portion and a second leg portion of a user. The pillow main body includes:

an upper left side edge, an upper right side edge, and a first contact surface, wherein the first contact surface extends between the upper left side edge and the upper right side edge, and the first contact surface is used for being in contact with the first leg portion;

a lower left side edge, a lower right side edge, and a second contact surface, wherein the second contact surface extends between the lower left side edge and the lower right side edge, the second contact surface is arranged opposite to the first contact surface, and the second contact surface is used for being in contact with the second leg portion;

an upper front side edge, a lower front side edge, and a front end surface, wherein the front end surface extends between the upper front side edge and the lower front side edge, and the front end surface is connected between the first contact surface and the second contact surface;

an upper rear side edge, a lower rear side edge, and a rear end surface, wherein the rear end surface extends between the upper rear side edge and the lower rear side edge, the rear end surface is arranged opposite to the front end surface, and the rear end surface is connected between the first contact surface and the second contact surface; and a through hole, wherein the through hole runs through the front end surface and the rear end surface.

As an improvement of the present invention, the pillow main body is provided with a first recessed portion positioned on the first contact surface. The first recessed portion is used for accommodating the first leg portion.

As an improvement of the present invention, the pillow main body is provided with a second recessed portion positioned on the second contact surface. The second recessed portion is used for accommodating the second leg portion.

As an improvement of the present invention, the first contact surface is provided with a first middle end portion at a middle position between the upper left side edge and the upper right side edge. A height of the upper left side edge is greater than a height of the first middle end portion, and a height of the upper right side edge is greater than the height of the first middle end portion.

As an improvement of the present invention, a surface of the first recessed portion is curved. A height of the first recessed portion decreases continuously or discontinuously from the upper left side edge and the upper right side edge towards the first middle end portion, respectively. A height range of the first recessed portion is 20 mm-40 mm.

As an improvement of the present invention, the second contact surface is provided with a second middle end portion at a middle position between the lower left side edge and the lower right side edge. A height of the lower left side edge is less than a height of the second middle end portion, and a height of the lower right side edge is less than the height of the second middle end portion.

As an improvement of the present invention, a surface of the second recessed portion is curved. A height of the second recessed portion increases continuously or discontinuously from the lower left side edge and the lower right side edge towards the first middle end portion, respectively. A height range of the second recessed portion is 20 mm-40 mm.

As an improvement of the present invention, a width of the upper front side edge is less than a width of the upper rear side edge.

As an improvement of the present invention, a width of the pillow main body continuously or discontinuously decreases from the upper rear side edge towards the upper front side edge.

As an improvement of the present invention, the pillow main body is provided with a left end surface extending between the upper left side edge and the lower left side edge. The pillow main body is provided with a third recessed portion positioned on the left end surface.

As an improvement of the present invention, the pillow main body is provided with a right end surface extending between the upper right side edge and the lower right side edge. The pillow main body is provided with a fourth recessed portion positioned on the right end surface.

As an improvement of the present invention, the pillow main body is provided with a left end surface extending between the upper left side edge and the lower left side edge. The left end surface is provided with a left front side edge and a left rear side edge both connected to the upper left side edge and the lower left side edge. A length of the left front side edge is less than a length of the left rear side edge. The pillow main body is provided with a right end surface extending between the upper right side edge and the lower right side edge. The right end surface is provided with a right front side edge and a right rear side edge both connected to the upper right side edge and the lower right side edge. A length of the right front side edge is less than a length of the right rear side edge.

As an improvement of the present invention, a height of the left end surface decreases continuously or discontinuously from the left rear side edge towards the left front side edge. A height of the right end surface decreases continuously or discontinuously from the right rear side edge towards the right front side edge. A maximum height range of the left end surface is 160 mm-180 mm, and a minimum height range of the left end surface is 100 mm-120 mm. A maximum height range of the right end surface is 160 mm-180 mm, and a minimum height range of the right end surface is 100 mm-120 mm.

As an improvement of the present invention, the pillow main body is provided with a fifth recessed portion positioned on the rear end surface. The rear end surface is provided with a fourth middle end portion at a middle position between the left rear side edge and the right rear side edge. A width of the fifth recessed portion continuously or discontinuously decreases from the left rear side edge and the right rear side edge towards the fourth middle end portion, respectively. A depth range of the fifth recessed portion is 20 mm-40 mm.

As an improvement of the present invention, the pillow main body is equipped with an arc-shaped protrusion positioned on the front end surface. The front end surface is equipped with a third middle end portion at a middle position between the left front side edge and the right front side edge. A width of the arc-shaped protrusion continuously decreases from the left front side edge and the right front side edge towards the third middle end portion, respectively. A width range of the arc-shaped protrusion is 210 mm-230 mm.

As an improvement of the present invention, the through hole includes a left part, a middle part, and a right part that are arranged in sequence. The left part, the middle part, and the right part are in communication in sequence. A longitudinal width of the middle part is less than a longitudinal width of the left part and a longitudinal width of the right part.

As an improvement of the present invention, a longitudinal width range of the middle part is 10 mm-30 mm. A longitudinal width range of the left part is 10 mm-30 mm. A longitudinal width range of the right part is 10 mm-30 mm. A length range of the through hole is 130 mm-150 mm. A depth range of the through hole is 210 mm-230 mm.

As an improvement of the present invention, a maximum relative length range between the front end surface and the rear end surface is 260 mm-280 mm. A maximum relative width range between the left end surface and the right end surface is 260 mm-280 mm.

As an improvement of the present invention, the pillow main body is made of memory foam.

As an improvement of the present invention, a density range of the pillow main body is 50 $kg/m^3$-70 $kg/m^3$.

Beneficial effects of the present invention are as follows. The leg pillow is provided in the present invention. The leg pillow includes the pillow main body. The pillow main body is used for supporting between the first leg portion and the second leg portion of the user. The pillow main body includes: the upper left side edge, the upper right side edge, the first contact surface, the lower left side edge, the lower right side edge, the second contact surface, the upper front side edge, the lower front side edge, the front end surface, the upper rear side edge, the lower rear side edge, the rear end surface, and the through hole. The first contact surface extends between the upper left side edge and the upper right side edge. The first contact surface is used for being in contact with the first leg portion. The second contact surface extends between the lower left side edge and the lower right side edge. The second contact surface is arranged opposite to the first contact surface. The second contact surface is used for being in contact with the second leg portion. The front end surface extends between the upper front side edge and the lower front side edge. The front end surface is connected between the first contact surface and the second contact surface. The rear end surface extends between the upper rear side edge and the lower rear side edge. The rear end surface is arranged opposite to the front end surface. The rear end surface is connected between the first contact surface and the second contact surface. The through hole runs through the front end surface and the rear end surface. Therefore, when a user sleeps on the side, the pillow main body is placed between the first leg portion above and the second leg portion below. At this time, the first contact surface of the pillow main body is in contact with the first leg portion, and the second contact surface is in contact with the second leg portion. The pillow main body fills a gap between two legs when sleeping on the side, providing support for an upper leg portion and greatly relieving the pressure on the upper leg portion. Due to the through hole defined between the front end surface and the rear end surface, when the pillow main body is placed between the legs in an identical direction with the through hole, the through hole is stressed and deformed under the pressure of the legs, so that a middle portion of the pillow main body collapses with the deformation of the through hole, and two ends of the pillow main body are also deformed and squeezed towards the middle portion, thereby forming a wrapping effect on the leg that applies the pressure, relieving the pressure on the legs and lumbar vertebra, and improving sleep quality.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
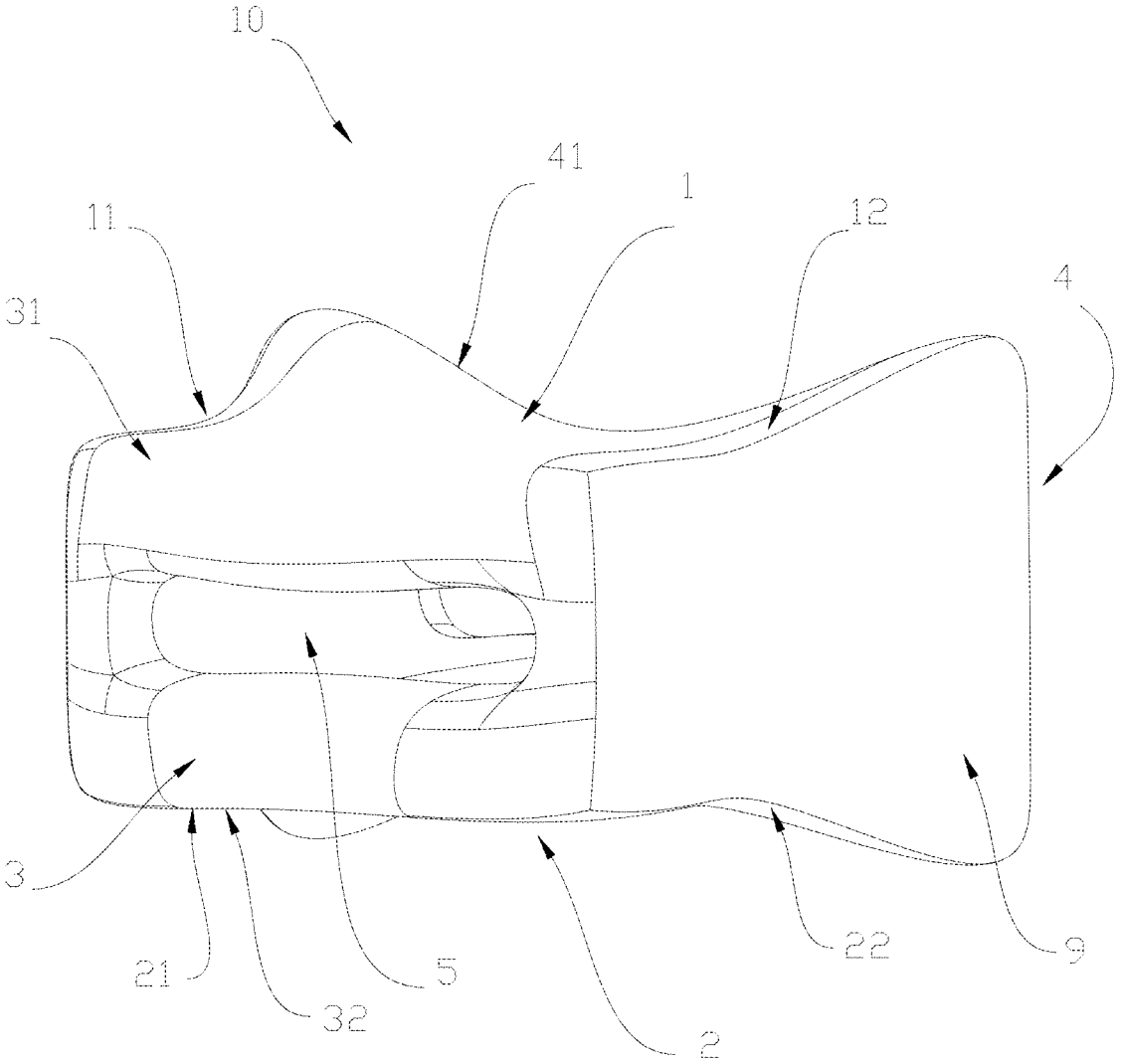
FIG. 1 is a perspective view of the present invention from a side thereof.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
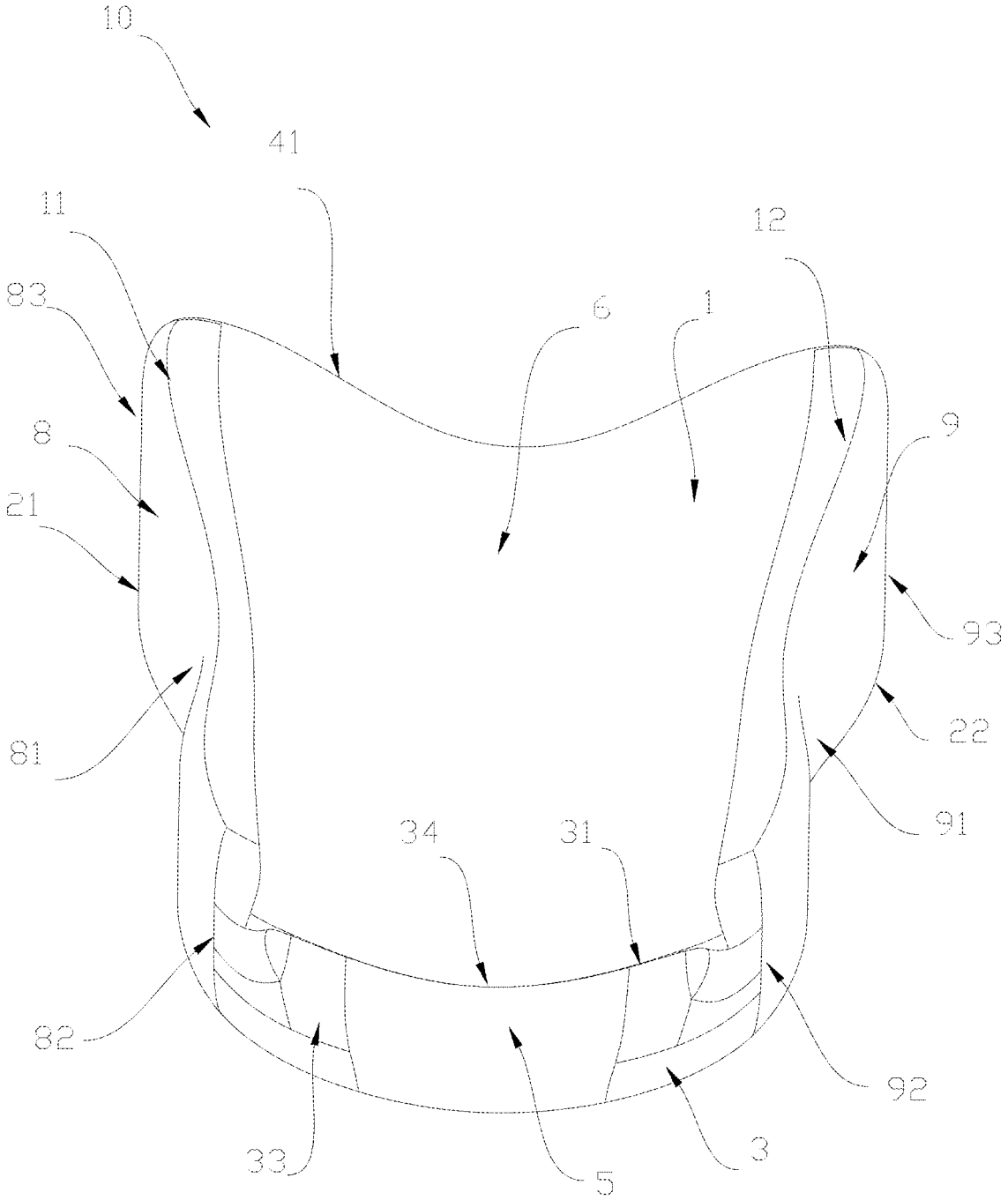
FIG. 2 is a perspective view of the present invention from above.
Figure 3:
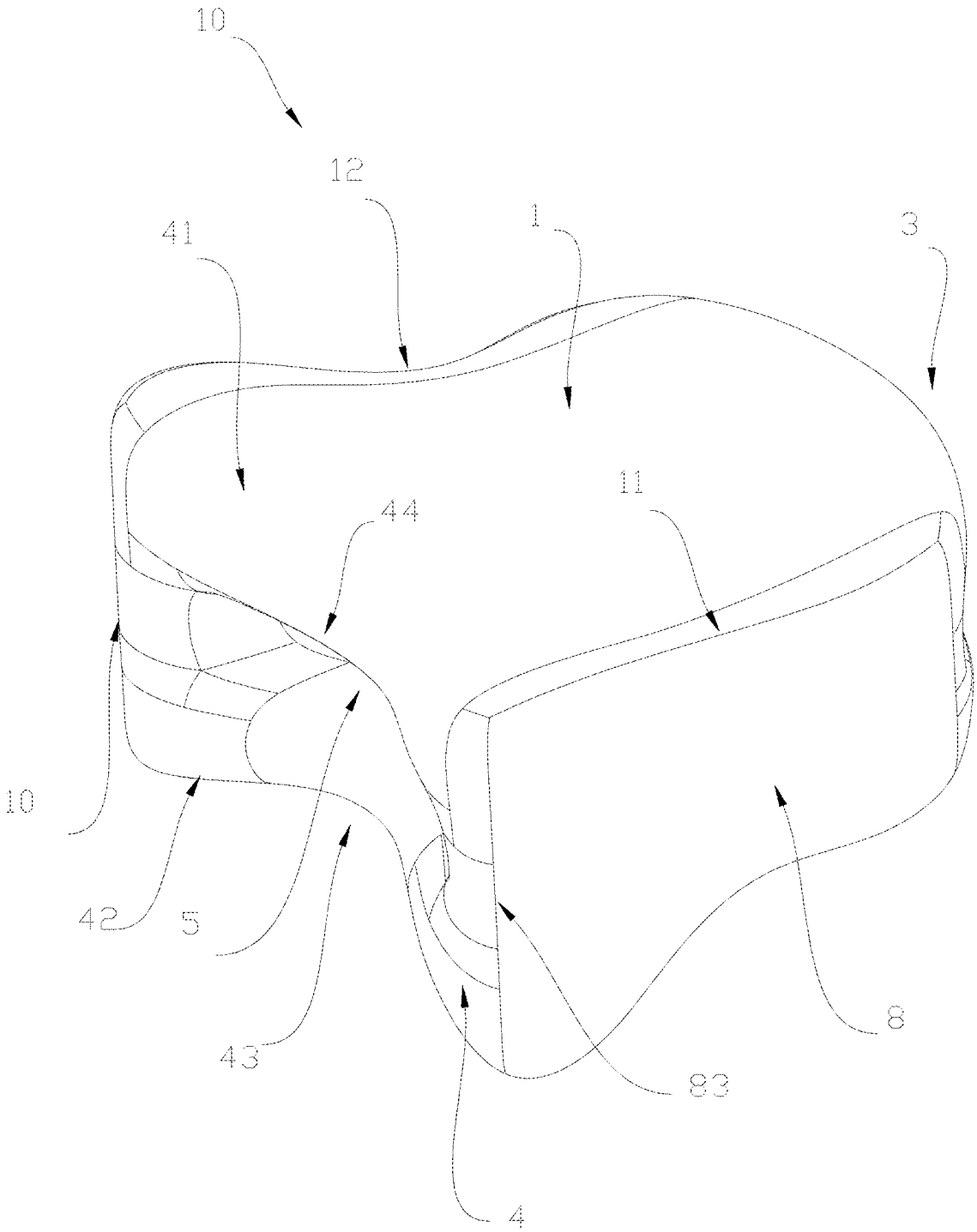
FIG. 3 is a perspective view of the present invention from another side.
Figure 4:
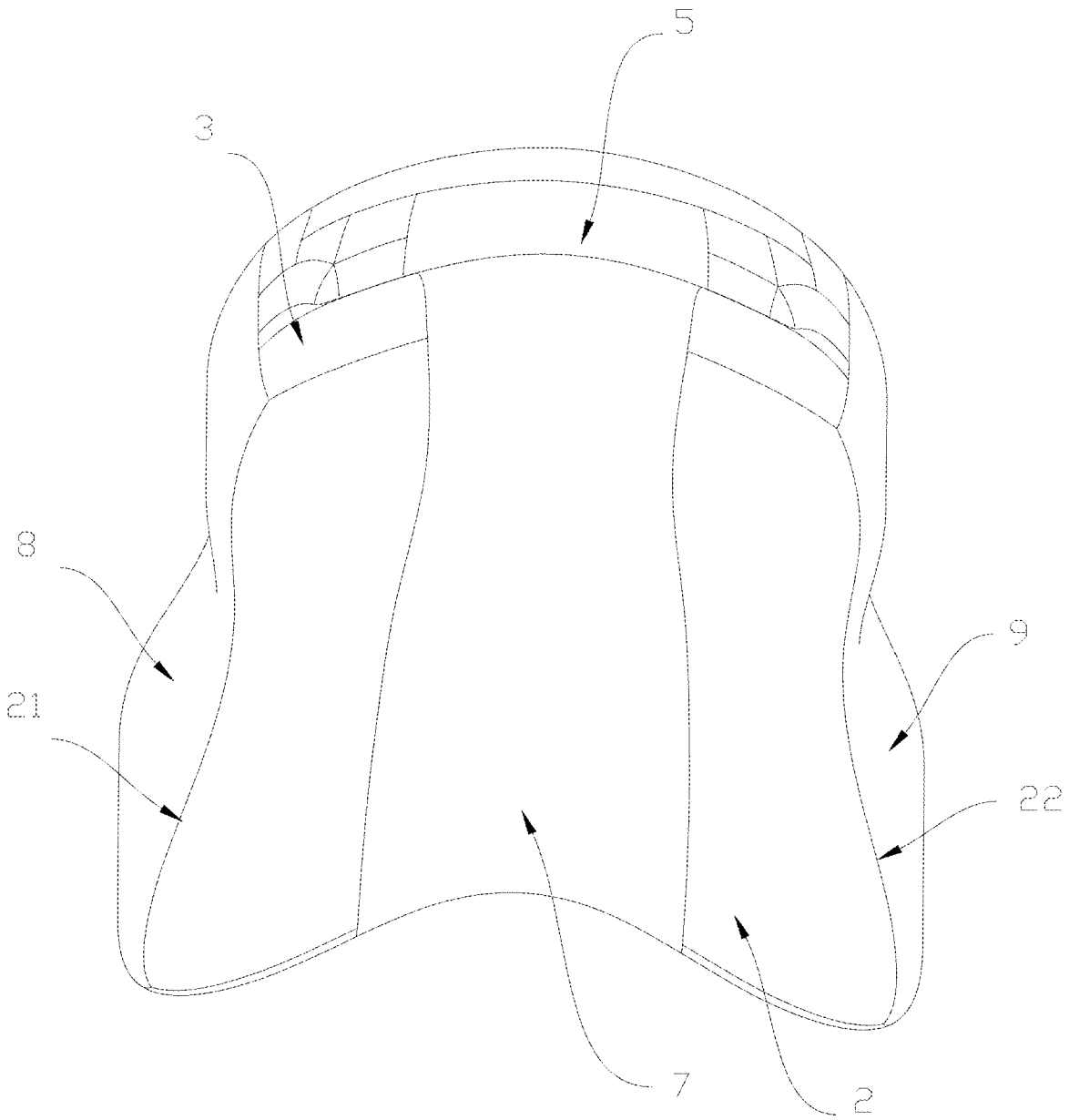
FIG. 4 is a perspective view of the present invention from below.
Figure 5:
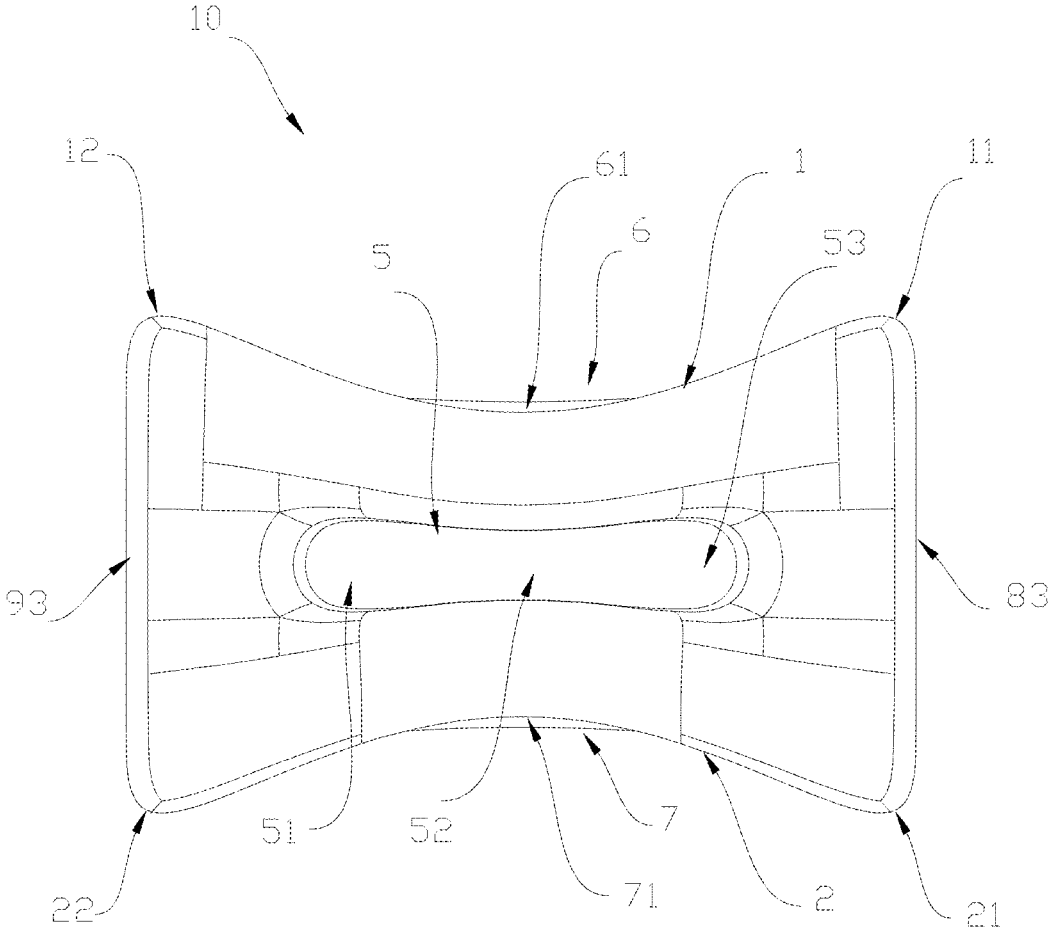
FIG. 5 is a rear view of the present invention.
Figure 6:
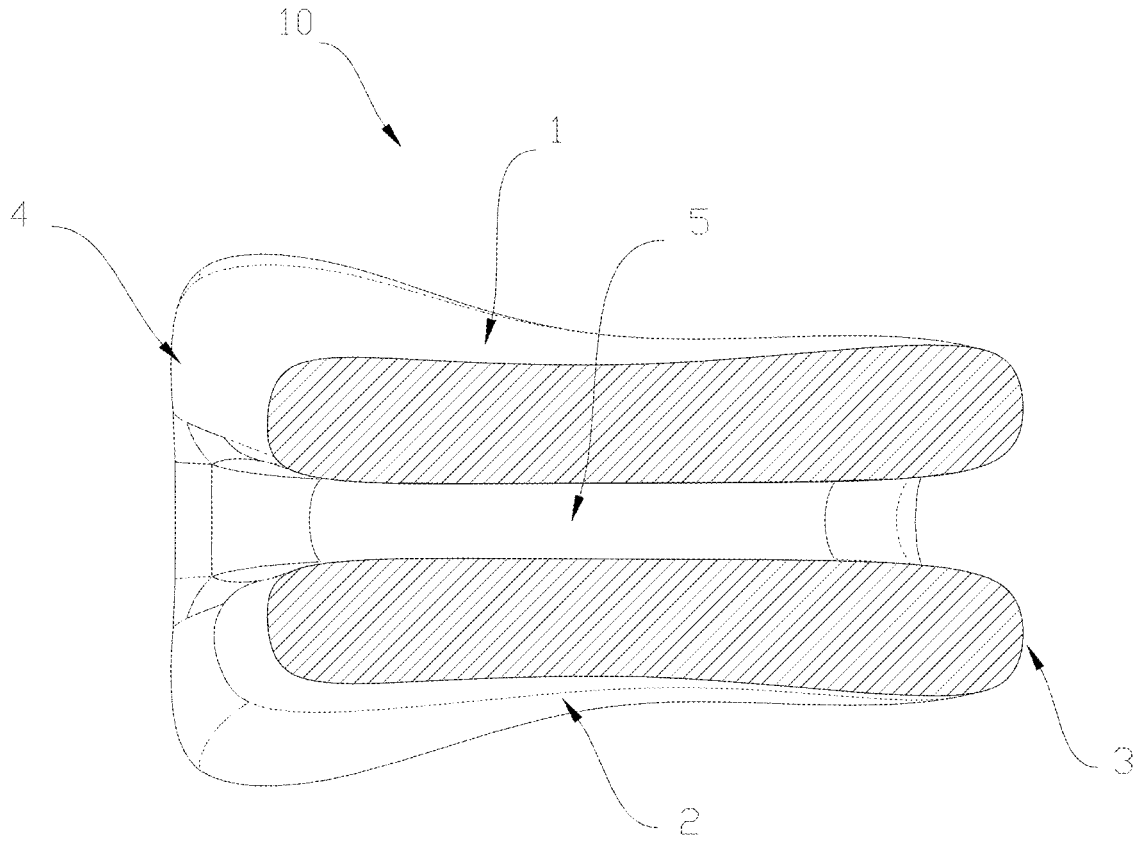
FIG. 6 is a sectional view of the present invention taken along a front end face and a rear end face.

Referring to FIGS. 1-6, a leg pillow includes a pillow main body 10. The pillow main body 10 is used for supporting between a first leg portion and a second leg portion of a user. The pillow main body 10 includes:

an upper left side edge 11, an upper right side edge 12, and a first contact surface 1, wherein the first contact surface 1 extends between the upper left side edge 11 and the upper right side edge 12, and the first contact surface 1 is used for being in contact with the first leg portion;

a lower left side edge 21, a lower right side edge 22, and a second contact surface 2, wherein the second contact surface 2 extends between the lower left side edge 21 and the lower right side edge 22, the second contact surface 2 is arranged opposite to the first contact surface 1, and the second contact surface 2 is used for being in contact with the second leg portion;

an upper front side edge 31, a lower front side edge 32, and a front end surface 3, wherein the front end surface 3 extends between the upper front side edge 31 and the lower front side edge 32, and the front end surface 3 is connected between the first contact surface 1 and the second contact surface 2;

an upper rear side edge 41, a lower rear side edge 42, and a rear end surface 4, wherein the rear end surface 4 extends between the upper rear side edge 41 and the lower rear side edge 42, the rear end surface 4 is arranged opposite to the front end surface 3, and the rear end surface 4 is connected between the first contact surface 1 and the second contact surface 2; and a through hole 5, wherein the through hole 5 runs through the front end surface 3 and the rear end surface 4.

Through the above structure, when a user sleeps on the side, the pillow main body 10 is placed between the first leg portion above and the second leg portion below. At this time, the first contact surface 1 of the pillow main body 10 is in contact with the first leg portion, and the second contact surface 2 is in contact with the second leg portion. The pillow main body 10 fills a gap between two legs when sleeping on the side, providing support for an upper leg portion and greatly relieving the pressure on the upper leg portion. Due to the through hole 5 defined between the front end surface 3 and the rear end surface 4, when the pillow main body 10 is placed between the legs in an identical direction with the through hole 5, the through hole 5 is stressed and deformed under the pressure of the legs, so that a middle portion of the pillow main body 10 collapses with the deformation of the through hole 5, and two ends of the pillow main body 10 are also deformed and squeezed towards the middle portion, thereby forming a wrapping effect on the leg that applies the pressure, relieving the pressure on the legs and lumbar vertebra, and improving sleep quality. Moreover, the leg pillow can ensure that the legs are at an identical height with the pelvis. When the spine is in a straight line, the pressure on the nerves will be released, greatly improving the pain situation. Pressure on a lower back and buttocks can also be relieved, and swelling in the lower back can be reduced, thereby helping people sleep well.

In this embodiment, the pillow main body 10 is provided with a first recessed portion 6 positioned on the first contact surface 1. The first recessed portion 6 is used for accommodating the first leg portion. Specifically, the first contact surface 1 is provided with a first middle end portion 61 at a middle position between the upper left side edge 11 and the upper right side edge 12. A height of the upper left side edge 11 is greater than a height of the first middle end portion 61, and a height of the upper right side edge 12 is greater than the height of the first middle end portion 61.

Furthermore, a surface of the first recessed portion 6 is curved. A height of the first recessed portion 6 decreases continuously or discontinuously from the upper left side edge 11 and the upper right side edge 12 towards the first middle end portion 61, respectively. A height range of the first recessed portion 6 is 20-40 mm. A maximum height of the first recessed portion 6 is 32.79 mm. The maximum height of the first recessed portion 6 in this embodiment is positioned at a tail end near the rear end surface 4.

Through the above structure, the first contact surface 1 is formed with the first recessed portion 6, and a direction of the first recessed portion 6 is consistent with a direction of the through hole 5, so that it is convenient for the user to quickly and correctly place the pillow main body 10 between the legs at a correct angle during use. The first recessed portion 6 plays a role of wrapping and position limiting while accommodating the first leg portion, making it less likely for the pillow main body 10 to shift. Moreover, the pillow main body 10 has a highest height on both sides near the rear end surface 4, so that the first recessed portion 6 has the maximum height, and the pillow main body 10 is formed with two protruding parts positioned at rear ends of both sides on the first contact surface 1. When the first leg portion is placed on the first recessed portion 6, the through hole 5 is deformed under the squeezing of the gravity of the first leg portion, and the protruding parts at both ends are squeezed towards the first leg portion, thereby wrapping the first leg portion, relieving leg pressure, and improving user comfort.

In this embodiment, the pillow main body 10 is provided with a second recessed portion 7 positioned on the second contact surface 2. The second recessed portion 7 is used for accommodating the second leg portion. Specifically, the second contact surface 2 is provided with a second middle end portion 71 at a middle position between the lower left side edge 21 and the lower right side edge 22. A height of the lower left side edge 21 is less than a height of the second middle end portion 71, and a height of the lower right side edge 22 is less than the height of the second middle end portion.

Furthermore, a surface of the second recessed portion 7 is curved. A height of the second recessed portion 7 increases continuously or discontinuously from the lower left side edge 21 and the lower right side edge 22 towards the first middle end portion 61, respectively. A height range of the second recessed portion 7 is 20 mm-40 mm. A maximum height of the second recessed portion 7 is 32.79 mm. The maximum height of the second recessed portion 7 in this embodiment is positioned at a tail end near the rear end surface 4.

Through the above structure, similarly, the second recessed portion 7 plays a role in wrapping and position limiting while accommodating the second leg portion, making it less likely for the pillow main body 10 to shift. Moreover, the pillow main body 10 has a lowest height on both sides near the rear end surface 4, so that the second recessed portion 7 has the maximum height, and the pillow main body 10 is formed with two protruding parts positioned at rear ends on both sides on the second contact surface 2. When the pillow main body 10 is clamped between the legs, the through hole 5 deforms, and the protruding parts on both ends of the second contact surface 2 are respectively squeezed towards the second leg portion, thereby wrapping the second leg portion, relieving leg pressure, and improving user comfort.

In this embodiment, a width of the upper front side edge 31 is less than a width of the upper rear side edge 41. A width of the lower front side edge 32 is less than a width of the lower rear edge 42. Furthermore, a width of the pillow main body 10 continuously or discontinuously decreases from the upper rear side edge 41 towards the upper front side edge 31. Through the above structure, the pillow main body 10 with a relatively narrow front end and a relatively wide rear end is formed. The front end surface 3 of the pillow main body 10 is the narrow end, and the rear end surface 4 is the wide end. When the pillow main body 10 is placed in a position of a thigh for use, the rear end faces one side of the thigh, and the front end faces and is close to one side of a knee. When the pillow main body 10 is placed in a position of a lower leg for use, the rear end is close to one side of the knee, and the front end is close to one side of an ankle. The pillow main body 10 with the relatively narrow front end and the relatively wide rear end is also more convenient for a customer to quickly adjust the leg pillow and place the leg pillow between the legs in a correct direction, so as to maximize the relief of pressure on the legs and lumbar spine, thereby improving the user experience.

In this embodiment, the pillow main body 10 is provided with a left end surface 8 extending between the upper left side edge 11 and the lower left side edge 21. The pillow main body 10 is provided with a third recessed portion 81 positioned on the left end surface 8. The pillow main body 10 is provided with a right end surface 9 extending between the upper right side edge 12 and the lower right side edge 22. The pillow main body 10 is provided with a fourth recessed portion 91 positioned on the right end surface 9. Through the above structure, the recesses arranged on the left end surface 8 and the right end surface 9 can not only reduce a weight of the pillow main body 10, but also improve the aesthetic appearance of the leg pillow.

In this embodiment, the pillow main body 10 is provided with a left end surface 8 extending between the upper left side edge 11 and the lower left side edge 21. The left end surface 8 is provided with a left front side edge 82 and a left rear side edge 83 both connected to the upper left side edge 11 and the lower left side edge 21. A length of the left front side edge 82 is less than a length of the left rear side edge 83. The pillow main body 10 is provided with a right end surface 9 extending between the upper right side edge 12 and the lower right side edge 22. The right end surface 9 is provided with a right front side edge 92 and a right rear side edge 93 both connected to the upper right side edge 12 and the lower right side edge 22. A length of the right front side edge 92 is less than a length of the right rear side edge 93.

Specifically, a height of the left end surface 8 decreases continuously or discontinuously from the left rear side edge 83 towards the left front side edge 82. A height of the right end surface 9 decreases continuously or discontinuously from the right rear side edge 93 towards the right front side edge 92. A maximum height range of the left end surface 8 is 160 mm-180 mm, and a minimum height range of the left end surface 8 is 100 mm-120 mm. A maximum height range of the right end surface 9 is 160 mm-180 mm, and a minimum height range of the right end surface 9 is 100 mm-120 mm. A maximum height of the left end surface 8 and the right end surface 9 is positioned at a rear end, with a height of 170 mm. A minimum height of the left end surface 8 and the right end surface 9 is positioned at a front end, with a height of 117.61 mm.

Through the above structure, the left end surface 8 and the rear end surface 4 both decrease from a rear side to a front side in height, and tend to be flat when approaching the front side, so that the pillow main body 10 forms a flat surface on the first contact surface 1 and the second contact surface 2 on a side near the front end surface 3. When the pillow main body 10 is placed between the legs, an area of the flat surface is close to the active knee or ankle. Compared with the rear side of the pillow main body 10 which has stronger wrapping properties, an area on the front side of the pillow main body 10 near the flat surface has weaker wrapping properties. Since this area is close to an active joint, it is necessary to reduce the wrapping properties to prevent the active joint from being affected and affecting sleep quality.

In this embodiment, the pillow main body 10 is provided with a fifth recessed portion 43 positioned on the rear end surface 4. The rear end surface 4 is provided with a fourth middle end portion 44 at a middle position between the left rear side edge 83 and the right rear side edge 93. A width of the fifth recessed portion 43 continuously or discontinuously decreases from the left rear side edge 83 and the right rear side edge 93 towards the fourth middle end portion 44, respectively. A depth range of the fifth recessed portion 43 is 20 mm-40 mm. Preferably, a maximum depth of the fifth recessed portion 43 is 30.78 mm. Through the above structure, the fifth recessed portion 43 positioned on the rear end surface 4 and protrusions on two sides of the first contact surface 1 and the second contact surface 2 jointly surround and form a wrapping area, providing stronger wrapping for the first leg portion and the second leg portion, and improving the comfort of using the leg pillow.

In this embodiment, the pillow main body 10 is equipped with an arc-shaped protrusion 33 positioned on the front end surface 3. The front end surface 3 is equipped with a third middle end portion 34 at a middle position between the left front side edge 82 and the right front side edge 92. A width of the arc-shaped protrusion 33 continuously decreases from the left front side edge 82 and the right front side edge 92 towards the third middle end portion 34, respectively. A width range of the arc-shaped protrusion 33 is 210 mm-230 mm. Preferably, the width of the arc-shaped protrusion 33 is 227.86 mm.

In this embodiment, the through hole 5 includes a left part 51, a middle part 52, and a right part 53 that are arranged in sequence. The left part 51, the middle part 52, and the right part 53 are in communication in sequence. A longitudinal width of the middle part 52 is less than a longitudinal width of the left part 51 and a longitudinal width of the right part 53.

Specifically, a longitudinal width range of the middle part 52 is 10 mm-30 mm. Preferably, the longitudinal width of the middle part 52 is 24.01 mm. A longitudinal width range of the left part 51 is 10 mm-30 mm. Preferably, the longitudinal width of the left part 51 is 29.45 mm. A longitudinal width range of the right part 53 is 10 mm-30 mm. Preferably, the longitudinal width of the right part 53 is 29.45 mm. A length range of the through hole 5 is 130 mm-150 mm. A depth range of the through hole 5 is 210 mm-230 mm. Through the above structure, the through hole 5 with a relatively narrow middle and two relatively wide ends is formed. When the pillow main body 10 is squeezed by the legs, the middle part 52 of the through hole 5 is a main squeezed point, and two sides of the through hole 5 are squeezed and deformed towards the middle part 52, thereby more effectively realizing the wrapping of the legs by both ends of the pillow main body 10.

In this embodiment, a maximum relative length range between the front end surface 3 and the rear end surface 4 is 260 mm-280 mm. Preferably, a maximum relative length between the front end surface 3 and the rear end surface 4 is 271.8 mm. A maximum relative width range between the left end surface 8 and the right end surface 9 is 260 mm-280 mm. Preferably, a maximum relative width between the left end surface 8 and the right end surface 9 is 270 mm.

In this embodiment, the pillow main body 10 is made of memory foam. Through the above structure, the pillow main body 10 made of memory foam can provide a more comfortable user experience.

In this embodiment, a density range of the pillow main body 10 is 50 kg/m$^3$-70 kg/m$^3$. Preferably, a density of the pillow main body 10 is 69 kg/m$^3$. Through the above structure, an appropriate density value enables the pillow main body 10 to provide more suitable support, thereby more effectively relieving pressure on the legs and lumbar spine.

In this embodiment, the pillow main body 10 is also equipped with a leg pillow case. The leg pillow case is equipped with a zipper. The zipper is positioned on a side wall of the pillow main body 10 for better disassembly and assembly. Moreover, an elastic band is further connected to the leg pillow case. The leg pillow can be fixed to the legs with the elastic band, thereby preventing the leg pillow from falling off during sleep.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A leg pillow, comprising:

a pillow main body, wherein the pillow main body is used for supporting between a first leg portion and a second leg portion of a user, and the pillow main body comprises:

an upper left side edge, an upper right side edge, and a first contact surface, wherein the first contact surface extends between the upper left side edge and the upper right side edge, and the first contact surface is used for being in contact with the first leg portion;

a lower left side edge, a lower right side edge, and a second contact surface, wherein the second contact surface extends between the lower left side edge and the lower right side edge, the second contact surface is arranged opposite to the first contact surface, and the second contact surface is used for being in contact with the second leg portion;

an upper front side edge, a lower front side edge, and a front end surface, wherein the front end surface extends between the upper front side edge and the lower front side edge, and the front end surface is connected between the first contact surface and the second contact surface;

an upper rear side edge, a lower rear side edge, and a rear end surface, wherein the rear end surface extends between the upper rear side edge and the lower rear side edge, the rear end surface is arranged opposite to the front end surface, and the rear end surface is connected between the first contact surface 1 and the second contact surface; and a through hole, wherein the through hole runs through the front end surface and the rear end surface;

wherein the through hole comprises a left part, a middle part, and a right part that are arranged in sequence; the left part, the middle part, and the right part are in communication in sequence; and a longitudinal width of the middle part is less than a longitudinal width of the left part and a longitudinal width of the right part;

wherein a longitudinal width range of the middle part is 10 mm-30 mm; a longitudinal width range of the left part is 10 mm-30 mm; a longitudinal width range of the right part is 10 mm-30 mm; a length range of the through hole is 130 mm-150 mm; and a depth range of the through hole is 210 mm-230 mm.

2. The leg pillow according to claim 1, wherein the pillow main body is provided with a first recessed portion positioned on the first contact surface; and the first recessed portion is used for accommodating the first leg portion.

3. The leg pillow according to claim 2, wherein the pillow main body is provided with a second recessed portion positioned on the second contact surface; and the second recessed portion is used for accommodating the second leg portion.

4. The leg pillow according to claim 3, wherein the second contact surface is provided with a second middle end portion at a middle position between the lower left side edge and the lower right side edge; a height of the lower left side edge is less than a height of the second middle end portion; and a height of the lower right side edge is less than the height of the second middle end portion.

5. The leg pillow according to claim 4, wherein a surface of the second recessed portion is curved; a height of the second recessed portion increases continuously or discontinuously from the lower left side edge and the lower right side edge towards the first middle end portion, respectively; and a height range of the second recessed portion is 20 mm-40 mm.

6. The leg pillow according to claim 2, wherein the first contact surface is provided with a first middle end portion at a middle position between the upper left side edge and the upper right side edge; a height of the upper left side edge is greater than a height of the first middle end portion; and a height of the upper right side edge is greater than the height of the first middle end portion.

7. The leg pillow according to claim 6, wherein a surface of the first recessed portion is curved; a height of the first recessed portion decreases continuously or discontinuously from the upper left side edge and the upper right side edge towards the first middle end portion, respectively; and a height range of the first recessed portion is 20 mm-40 mm.

8. The leg pillow according to claim 1, wherein a width of the upper front side edge is less than a width of the upper rear side edge.

9. The leg pillow according to claim 8, wherein a width of the pillow main body continuously or discontinuously decreases from the upper rear side edge towards the upper front side edge.

10. The leg pillow according to claim 1, wherein the pillow main body is provided with a left end surface extending between the upper left side edge and the lower left side edge; and the pillow main body is provided with a third recessed portion positioned on the left end surface.

11. The leg pillow according to claim 1, wherein the pillow main body is provided with a right end surface extending between the upper right side edge and the lower right side edge; and the pillow main body is provided with a fourth recessed portion positioned on the right end surface.

12. The leg pillow according to claim 1, wherein the pillow main body is provided with a left end surface extending between the upper left side edge and the lower left side edge; the left end surface is provided with a left front side edge and a left rear side edge both connected to the upper left side edge and the lower left side edge; a length of the left front side edge is less than a length of the left rear side edge; the pillow main body is provided with a right end surface extending between the upper right side edge and the lower right side edge; the right end surface is provided with a right front side edge and a right rear side edge both connected to the upper right side edge and the lower right side edge; and a length of the right front side edge is less than a length of the right rear side edge.

13. The leg pillow according to claim 12, wherein a height of the left end surface decreases continuously or discontinuously from the left rear side edge towards the left front side edge; a height of the right end surface decreases continuously or discontinuously from the right rear side edge towards the right front side edge; a maximum height range of the left end surface is 160 mm-180 mm; a minimum height range of the left end surface is 100 mm-120 mm; a maximum height range of the right end surface is 160 mm-180 mm; and a minimum height range of the right end surface is 100 mm-120 mm.

14. The leg pillow according to claim 12, wherein a maximum relative length range between the front end surface and the rear end surface is 260 mm-280 mm; and a maximum relative width range between the left end surface and the right end surface is 260 mm-280 mm.

15. The leg pillow according to claim 1, wherein the pillow main body is provided with a fifth recessed portion positioned on the rear end surface; the rear end surface is provided with a fourth middle end portion at a middle position between the left rear side edge and the right rear side edge; a width of the fifth recessed portion continuously or discontinuously decreases from the left rear side edge and the right rear side edge towards the fourth middle end portion, respectively; and a depth range of the fifth recessed portion is 20 mm-40 mm.

16. The leg pillow according to claim 1, wherein the pillow main body is equipped with an arc-shaped protrusion positioned on the front end surface; the front end surface is equipped with a third middle end portion at a middle position between the left front side edge and the right front side edge; a width of the arc-shaped protrusion continuously decreases from the left front side edge and the right front side edge towards the third middle end portion, respectively; and a width range of the arc-shaped protrusion is 210 mm-230 mm.

17. The leg pillow according to claim 1, wherein the pillow main body is made of memory foam.

18. The leg pillow according to claim 1, wherein a density range of the pillow main body is 50 $kg/m^3$-70 $kg/m^3$.

* * * * *